US005662159A

United States Patent [19]

Iwamoto et al.

[11] Patent Number: 5,662,159

[45] Date of Patent: Sep. 2, 1997

[54] METHOD AND APPARATUS OF CONTROLLING INJECTION OF DIE CASTING MACHINE

[75] Inventors: Norihiro Iwamoto, Sagamihara; Masayuki Takamura, Oyama, both of Japan

[73] Assignee: Toshiba Kikai Kabushiki Kaisha, Tokyo, Japan

[21] Appl. No.: 622,594

[22] Filed: Mar. 26, 1996

[30] Foreign Application Priority Data

Mar. 27, 1995 [JP] Japan ..... 7-067844

[51] Int. Cl.[6] ..... B22D 17/32

[52] U.S. Cl. ..... 164/457; 164/113; 164/155.3; 164/312

[58] Field of Search ..... 164/457, 155.3, 164/151, 151.1, 113, 312

[56] References Cited

FOREIGN PATENT DOCUMENTS 1-186257 7/1989 Japan ..... 164/457

*Primary Examiner*—Kuang Y. Lin

*Attorney, Agent, or Firm*—Finnegan, Henderson, Farabow, Garrett & Dunner, L.L.P.

[57] ABSTRACT

A method and an apparatus of controlling the injection of a die casting machine can be used for any existing metal molds without requiring the use of a metal charge front sensor and shift the speed of advancement of the plunger rod to initiate a forced speed reduction of the plunger at a right timing regardless of variances in the charge of molten metal so that the machine may stably produce quality die cast products. Such a method of controlling the injection of a die casting machine for injecting molten metal fed to an injection sleeve into a metal mold by means of an injection plunger 100 to charge the metal mold with molten metal comprises the steps of detecting the pressure of the plunger rod charging the metal mold with molten metal; determining that the molten metal has arrived the gate section, or injection port, of the metal mold at a time when the detected pressure gets to a predetermined value; and controlling the injection speed on the basis of the time.

5 Claims, 4 Drawing Sheets

METHOD AND APPARATUS OF CONTROLLING INJECTION OF DIE CASTING MACHINE

BACKGROUND OF THE INVENTION

1. Field of the Invention

This invention relates to a method and an apparatus of controlling the injection of a die casting machine and, more particularly, it also relates to a method and an apparatus of controlling the injection of a die casting machine so as to shift the injection speed from low to high in the course of an injection stroke.

2. Prior Art

In a conventional die casting machine for injecting molten metal fed to an injection sleeve into a cavity of a metal mold by means of an injection plunger to charge the metal mold with molten metal, the plunger rod is advanced at a low rate in the initial phase of a charging stroke until the front end of a charge of molten metal gets to the gate of the metal mold and the frontal space of the plunger rod is filled with molten metal in order to prevent the charge of molten metal from containing air bubbles and, once the frontal space of the plunger rod is filled with molten metal, the advancement of the plunger rod is shifted to a high rate in order to fill the cavity of the metal mold at an enhanced speed.

The injection speed of a die casting machine is determined as a function of the wall thickness of the product and the time required for the product to become solidified and the operation of injecting molten metal and filling the cavity of the metal mold with molten metal has to be completed before the charge of molten metal is solidified. A higher injection speed is required as products having a reduced wall thickness and a complicated profile are produced in recent years.

The kinetic energy Q of a charge of molten metal when it is injected into a metal mold cavity is defined $Q=m\cdot V^2/2$, where m is the mass of the charge and V is the injection speed (the rate of advancement of the plunger rod). Thus, the kinetic energy increases as a higher injection speed V is used as we see in recent years so that the plugger rod is required to reduce its speed accurately Just before the completion of the charging stroke.

The timing for starting the speed reduction is simply determined by the position of the plunger rod if the charge of molten metal brought into the injection sleeve from a ladle for each die casting cycle is always constant. However, in reality, the charge of molten metal brought into the injection sleeve from a ladle shows fluctuations from cycle to cycle.

If the timing for starting the speed reduction is predetermined corresponding to a defined charge of molten metal and hence to a given position of the plunger rod, the plunger rod prematurely starts reducing its speed if the current charge is short of the defined charge. The net result will be a pressure rise time lag due to an insufficient charge and an interrupted flow of molten metal. On the other hand, the plunger rod starts reducing its speed after passing an optimal time point to bring forth flashes or fins on the product as a result of overcharging if the current charge exceeds the defined charge.

In an attempt to solve these problems, there has been proposed an apparatus for controlling the injection speed. The apparatus comprises a metal charge front sensor disposed at the gate of the metal mold for exactly detecting the time when the front end of a charge of molten metal arrives the gate. During an injection stroke at high injection speed, an injection control program is executed by using a speed profile which is predetermined according to a position of a plunger rod and which includes a forced speed reduction part before the completion of injection. The injection speed control program variably starts operating as a function of the time when the metal charge front sensor detects the front end of the charge.

However, since the metal charge front sensor of a proposed apparatus for controlling the injection speed has to be arranged in the metal mold, it cannot be used with an existing metal mold without modifying it. Additionally, the metal charge front sensor is often accompanied by a number of problems including malfunction and broken wires to make the maintenance of itself and the metal mold rather cumbersome.

SUMMARY OF THE INVENTION

In view of the above identified problems, it is therefore an object of the present invention to provide a method and an apparatus of controlling the injection of a die casting machine that can be used for any existing metal molds without requiring the use of a metal charge front sensor and can shift the speed of advancement of the plunger rod to initiate a forced speed reduction of the plunger at a right timing regardless of variances in the charge of molten metal so that the machine may produce die cast products of stable quality.

According to a first aspect of the invention, the above object is achieved by providing a method of controlling the injection of a die casting machine for injecting molten metal fed to an injection sleeve into a metal mold by means of an injection plunger to charge the metal mold with molten metal, comprising the steps of: detecting the pressure of a plunger rod charging the metal mold with molten metal; determining that the molten metal has arrived the gate section, or injection port, of the metal mold at a time when the detected pressure gets to a predetermined value; and controlling the injection speed on the basis of the time.

According to a second aspect of the invention, there is also provided a method of controlling the injection of a die casting machine for injecting molten metal fed to an injection sleeve into a metal mold by means of an injection plunger to charge the metal mold with molten metal, comprising the steps of: detecting pressure of a plunger rod charging the metal mold with molten metal; integrating continuous rise of the pressure with time; determining that the molten metal has arrived the gate section, or injection port, of the metal mold at a time when the integral value gets to a predetermined value; and controlling the injection speed on the basis of the time.

In a preferred embodiment of each of the above described methods, the operation of controlling the injection speed is executed in such that, before the time, the rate of advancement of the plunger rod is controlled by feed-back so as to make it a target value, and after the time, the rate of advancement of the plunger rod is controlled according to a predetermined profile which is defined as a function of a position of the plunger rod and which includes a forced speed reduction part before the completion of injection.

According to a third aspect of the invention, there is also provided an apparatus of controlling the injection of a die casting machine for injecting molten metal fed to an injection sleeve into a metal mold by means of an injection plunger to charge the metal mold with molten metal, comprising: a detection means for detecting pressure of a plunger rod charging the metal mold with molten metal; and an injection speed control means for receiving a detection signal from said detection means, operating a low injection speed phase for the advancement of the plunger rod until the detected pressure gets to a predetermined value, and switching the operation from the low injection speed phase to a high injection speed phase when the detected pressure gets to the predetermined value.

According to a fourth aspect of the invention, there is also provided an apparatus of controlling the injection of a die casting machine for injecting molten metal fed to an injection sleeve into a metal mold by means of an injection plunger to charge the metal mold with molten metal, comprising: a detection means for detecting pressure of a plunger rod charging the metal mold with molten metal; an integrator for integrating with time the continuous rise of the pressure detected by the detection means; and an injection speed control means for receiving an integral value from said integrator and switching an operation of the plunger rod from a low injection speed phase to a high injection speed phase when the integral value gets to a predetermined value.

The above inventions are based on the following technical principle. The pushing force which is required for the plunger rod to charge the metal mold with the molten metal depends on the charging resistance of the molten metal against the metal mold and thus increases according to the increase of the charging resistance. Since the gate part of the metal mold for die casting is generally constricted, when the molten metal reaches the gate part, the charging resistance increases and then the pushing force which is required for the plunger rod to charge the metal mold with the molten metal increases. For this reason, the increase of the pushing force can indicates that the molten metal reaches the gate part.

With a method of controlling the injection of a die casting machine according to the first aspect of the invention, the pressure of the plunger rod charging the metal mold with molten metal is detected to start the operation of controlling the injection speed when the detected pressure gets to a predetermined value, determining that the charge of metal mold has arrived the gate section of the metal mold.

With a method of controlling the injection of a die casting machine according to the second aspect of the invention, the continuous rise of the pressure of the plunger rod charging the metal mold with molten metal is integrated with time to start the operation of controlling the injection speed when the integral value gets to a predetermined value, determining that the charge of metal mold has arrived the gate section of the metal mold.

With each of the above described methods, a low injection speed phase of an injection stroke continues until the pressure of the plunger rod gets to a predetermined value or the integral value of the continuous rise of pressure with time gets to a predetermined value and the rate of advancement of the plunger rod is controlled by feed-back so as to gets to a target value in this phase or in the initial phase of the injection/charging stroke. When the pressure of the plunger rod gets to the predetermined value or the integral value of the continuous rise of pressure with time gets to the predetermined value, the initial phase of the injection/charging stroke is terminated and the plunger rod is made to follow a predetermined speed profile as a function of the displacement of the plunger rod.

With an apparatus of controlling the injection of a die casting machine according to the third aspect of the invention, the pressure of the plunger rod charging the metal mold with molten metal is detected by a detection means and an injection speed control means operates a low injection speed phase for the advancement of the plunger rod until the detected pressure gets to a predetermined value and switches the operation from the low injection speed phase to a high injection speed phase when the detected pressure gets to the predetermined value.

With an apparatus of controlling the injection of a die casting machine according to the fourth aspect of the invention, the pressure of the plunger rod charging the metal mold with molten metal is detected by a detection means and the continuous rise with time of the pressure of the plunger rod is integrated by an integrator. Then, an injection speed control means operates a low injection speed phase for the advancement of the plunger rod until the integral value produced by the integrator gets to a predetermined value and switches the operation from the low injection speed phase to a high injection speed phase when the integral value gets to the predetermined value.

The nature, principle and utility of the invention will become more apparent from the following detailed description when read in conjunction with the accompanying drawings.

DETAILED DESCRIPTION OF THE PREFERRED EMBODIMENTS

Now, the present invention will be described in greater detail by referring to the accompanying drawings that illustrate preferred embodiments of the invention.

Figure 1:
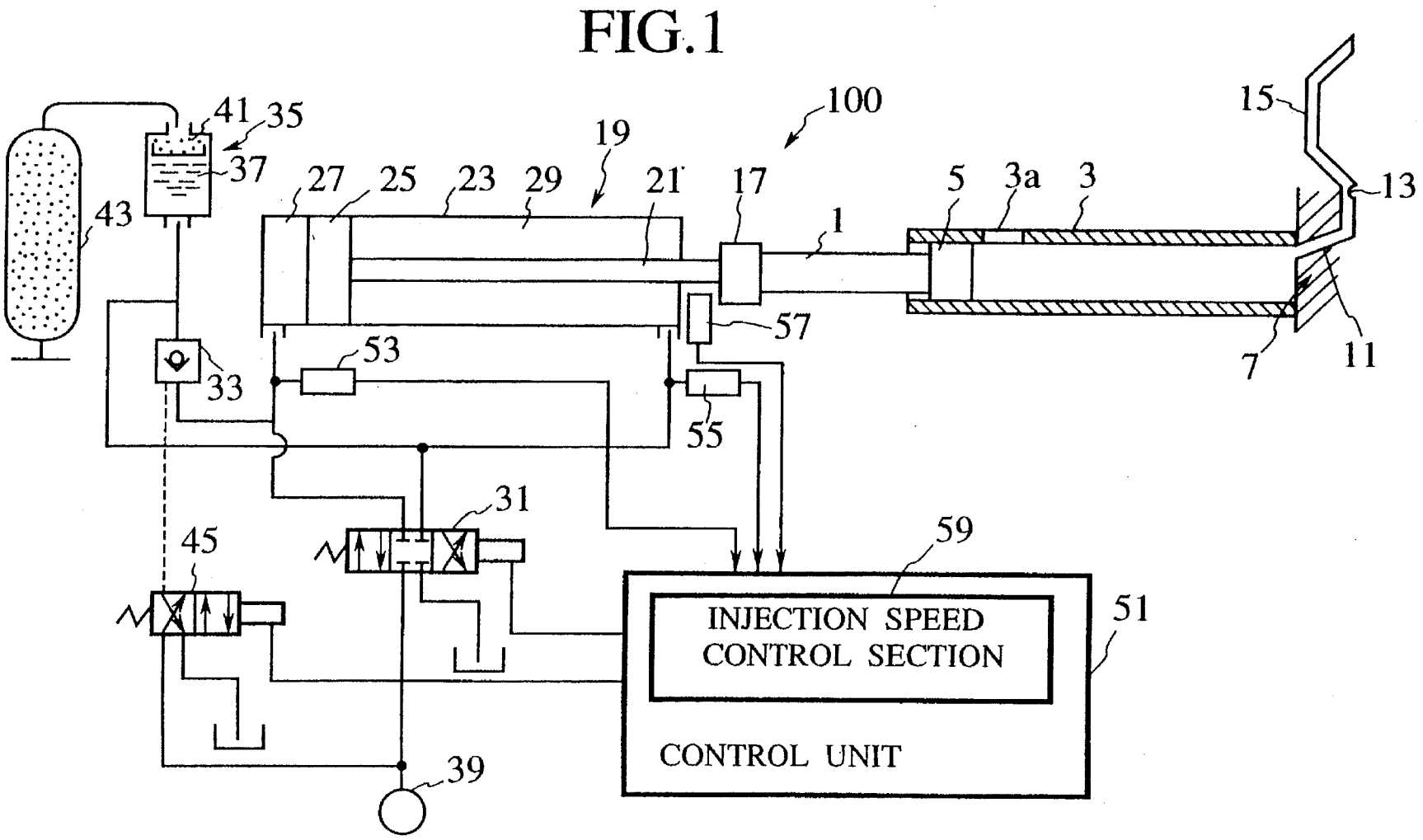
FIG. 1 is a schematic block diagram of an embodiment of injection control apparatus of a die casting machine according to the invention.

FIG. 1 is a schematic block diagram of an embodiment of injection control apparatus of a die casting machine according to the invention.

An injection plunger 100 comprises a cylinder tube 23, a piston rod 21, a plunger rod 1, a coupling 17, and a plunger tip 5.

The die casting machine comprises a plunger rod 1, an injection sleeve 3 for receiving therein said plunger rod 1 to allow it to reciprocate. As molten metal is fed into the injection sleeve from a ladle (not shown) through an inlet 3*a* and the plunger rod 1 is advanced, the plunger tip 5 disposed at the front end of the plunger pushes the molten metal in the injection sleeve 3 so that it is injected into a runner section 11, a gate section 13 and a product cavity section 15 of a metal mold 7 sequentially.

The plunger rod 1 is connected to a piston rod 21 of an injection cylinder unit 19 by means of a coupling 17 and driven to reciprocate by the injection cylinder unit 19.

The injection cylinder unit 19 is a hydraulic pressure cylinder unit having a cylinder tube 23 provided therein with a pressure chamber 27 and a back pressure chamber 29 disposed at the respective opposite ends of the tube. The pressure chamber 27 and the back pressure chamber 29 are connected to each other by way of a servo valve 31 and the pressure chamber 27 is additionally connected to a pressure chamber 37 of a piston accumulator 35 by way of a pilot check valve 33.

The servo valve 31 is used to select a closed position, a first change-over position for connecting the pressure chamber 27 to a hydraulic pressure source 39 and the back pressure chamber 29 to a drain in order to drive the plunger rod 1 to move forward and a second change-over position for connecting the pressure chamber 27 to the drain and the back pressure chamber 29 to the hydraulic pressure source 39 in order to drive the plunger rod 1 to move backward. In the first change-over position, the servo valve 31 quantitatively controls the connection between back pressure chamber 29 and the drain to consequently control the back pressure and hence the rate of advancement of the plunger rod 1.

The piston accumulator 35 is of a pneumatic pressure type comprising a back pressure chamber 41 connected to a gas accumulation tank 43. When the servo valve 31 is switched to the second change-over position, it is connected to the hydraulic pressure source 39 to fill the pressure chamber 37 with oil under pressure.

The pilot check valve 33 is selectively closed when it is fed with pilot oil from the hydraulic pressure source 39 by way of a transfer valve 45.

The servo valve 31 and the transfer valve 45 are controlled by a control unit 51 connected to a first pressure sensor 53 for detecting the pressure in the pressure chamber 27, a second pressure sensor for detecting the pressure in the back pressure chamber 29 and a displacement sensor 57 for detecting the (positional) displacement of the piston rod 21 or the plunger rod 1.

The control unit 51 comprises an injection speed control section 59, which calculates the pressure required to drive the plunger rod 1 to move forward and fill the metal mold with molten metal from pressure P1 in the pressure chamber 27 detected by the first pressure sensor 53 and pressure P2 in the back pressure chamber 29 detected by the second pressure sensor 55. If the surface area of the piston 25 for bearing pressure is A1 and the cross sectional area of the piston rod 21 is A2, pressure P required to drive the plunger rod 1 to move forward is calculated by the equation shown below.

$$P=P1-\{(A1-A2)/A1\}\cdot P2$$

Since the plunger rod 1 is driven by the injection cylinder unit 19, the pressure required for the plunger rod 1 to push the molten metal forward to fill the metal mold can be determined by the pressure (forward drive pressure) P required for the injection cylinder unit 19 to drive the plunger rod 1 to move forward.

Injection speed control section 59 maintains the rate of advancement V of the plunger rod 1 to a low injection rate (initial rate) V1 until the forward drive pressure P gets to a predetermined value Pset which is selected as a function of the profile of the gate section 13 of the metal mold 7 and other factors, calculates the rate of advancement V of the plunger rod 1 from change with time of the displacement of the plunger rod 1 detected by the displacement sensor 57 and controls by feed-back the rate of advancement V of the plunger rod 1 so as to make it get to a target value. Once the forward drive pressure P gets to the predetermined value Pset, it switches the rate of advancement V of the plunger rod 1 from the low injection rate to a high injection rate.

Figure 2:
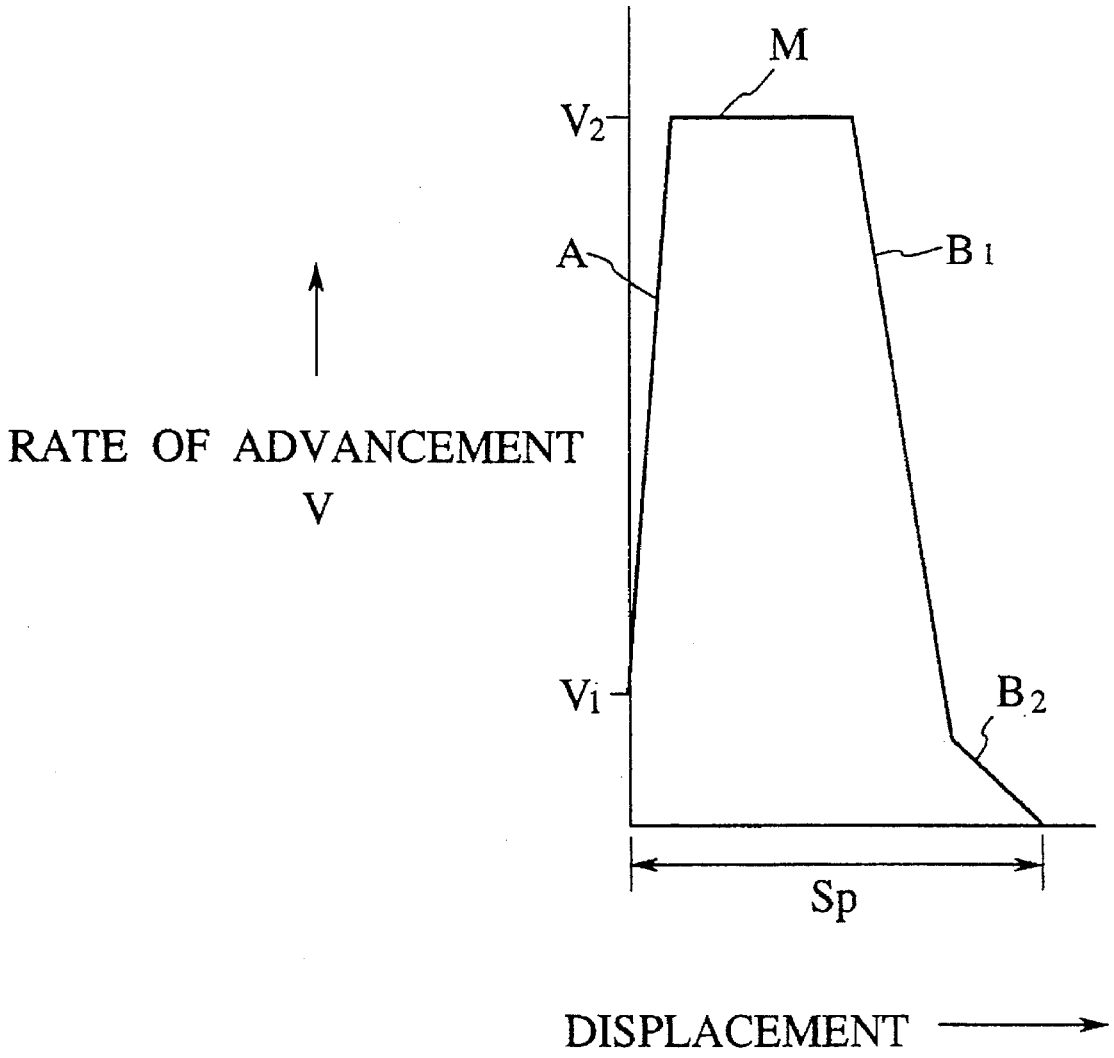
FIG. 2 is a graphic illustration of a speed profile that can be used for a program controlling the injection speed of a die casting machine for the purpose of the invention.

More specifically, once the forward drive pressure P gets to the predetermined value Pset, the injection speed control section 59 starts an injection speed control program to control the plunger rod 1 according to a predetermined speed profile (pattern) as shown in FIG. 2 defined as a function of the displacement of the plunger rod 1.

The speed profile shown in FIG. 2 and used for an injection speed control program comprises an acceleration phase A between initial rate V1 and maximum rate V2, a plateau phase M for maintaining the maximum rate V2 for a predetermined period, a first deceleration phase B1 for rapidly decelerating the rate of advancement from the maximum rate V2 to a level of the initial rate V1 and a slow deceleration phase B2 from the end of the first deceleration phase B1 to the dead end (V=0) of the advancement of the plunger rod 1.

The injection stroke Sp defined by the speed profile is a simple function of the volume of the metal mold 7 between the gate section 13 and the product cavity section 15.

Therefore, if the injection speed control program using the speed profile is started when the front end of the charge of molten metal gets to the gate section 13 of the molten meal 7, the injection speed control program always ends exactly when the product cavity is completely charged with molten metal.

Figure 3:
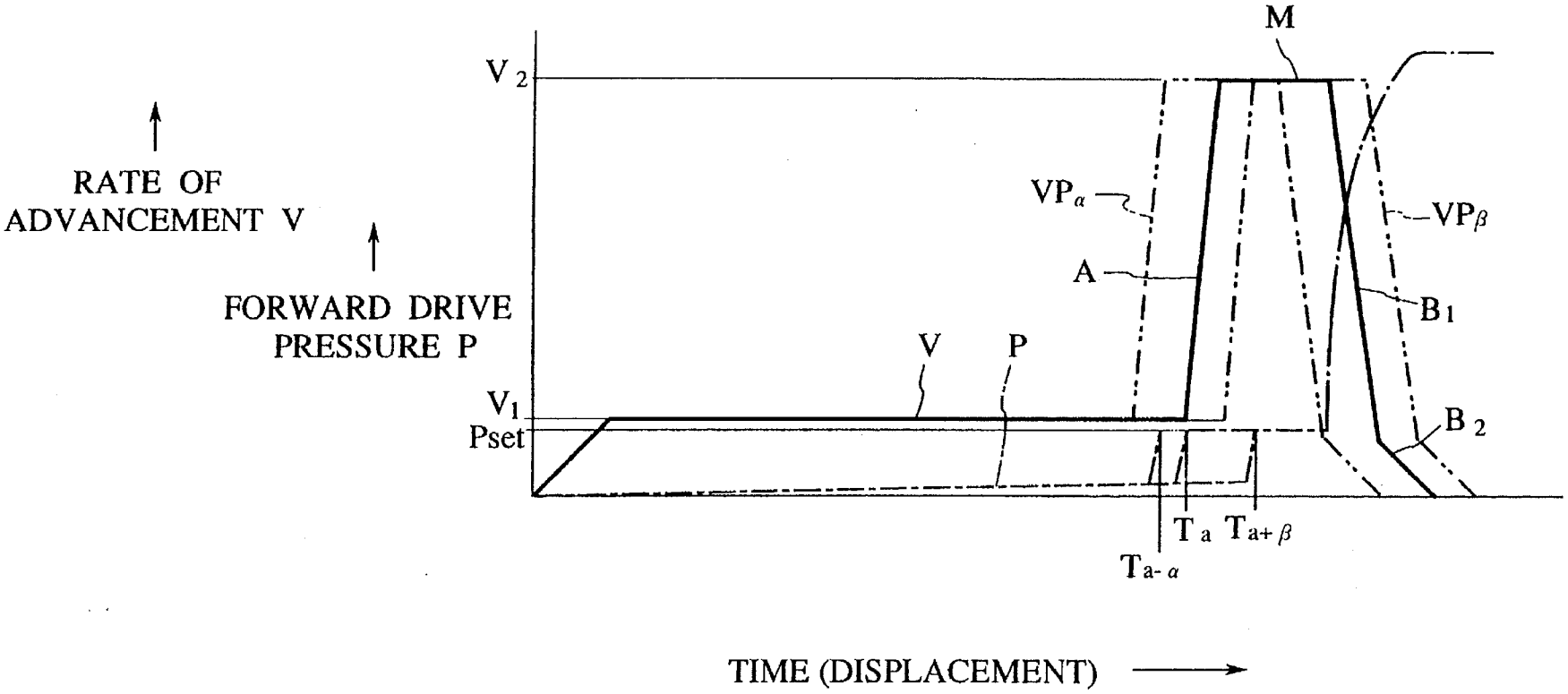
FIG. 3 is a graph showing the relationship between the forward drive pressure and the change in the speed of advancement of an plunger rod that can be used for controlling a die casting machine by a method according to the invention; and, FIG. 4 is a schematic block diagram of another embodiment of injection control apparatus of a die casting machine according to the invention.

Now, the operation of the above embodiment of apparatus of controlling the injection of a die casting machine will be described by referring to FIG. 3.

In a stand-by state, the plunger rod 1 is located at a retracted position as shown in FIG. 1 and the pressure chamber 37 of the piston accumulator 35 is filled with oil as the servo valve 31 is closed. The transfer valve 45 is switched to a position for draining the pilot oil in the pilot check value 33, which is in the closed normal position.

For a die casting operation, molten metal is introduced into the injection sleeve 3 from a ladle (not shown) by way of the inlet 3*a* in the above described stand-by state and then a start command is issued to the control unit 51.

Then, the transfer valve 45 is switched to feed the pilot oil into the pilot check value 33 and open the latter and, at the same time, servo valve 31 is switched to a first position to connect the pressure chamber 27 of the injection cylinder unit 19 to the hydraulic pressure source 39, while the back pressure chamber 29 is drained.

Thus, the injection cylinder unit 19 is driven to operate for an advancement cycle and the plunger rod 1 starts advancing to move the molten metal in the injection sleeve 3 into the metal mold 7.

The speed at which the plunger rod 1 is advanced is controlled to conform to the preselected low injection rate (initial rate) V1 by the servo valve 31 that controls the connection between the back pressure chamber 29 and the drain. The displacement sensor 57 detects the change with time of the displacement of the plunger rod 1 and calculate the rate of advancement V of the plunger rod 1, which is then fed back and used to control the rate of advancement V of the plunger rod 1 so as to make it conform to the target value or the low injection rate V1.

In low injection rate phase, the control unit 51 receives pressure detection signals representing pressures P1 and P2 from the pressure sensors 53 and 55 and calculates the forward drive pressure P therefrom. The injection speed control section 59 determines if the forward drive pressure P has got to the predetermined value Pset or not.

As the front end of the charge of molten metal passes through the runner section 11 and gets to the gate section 13 to fill the space in front of the plunger tip 5 in the injection sleeve 3 in the low injection rate phase, the molten metal tends to flow into the product cavity section 15 through the gate section 13. Consequently, the resistance against the molten metal is increased to raise the forward drive pressure P until it gets to the predetermined value Pset.

If, at time Ta, the forward drive pressure P gets to the predetermined value Pset, the injection speed control program starts operating from the time Ta, using a preselected speed profile as shown in FIG. 2.

As a result, the rate of advancement V of the plunger rod 1 is rapidly accelerated to follow the acceleration phase A of the speed profile until it gets to the maximum rate Subsequently, the first deceleration phase B1 and the second deceleration phase B2 take place to forcibly decelerate the plunger rod 1. When the plunger rod 1 has advanced from the start of the injection speed control program by a distance equal to the injection stroke Sp, the plunger rod 1 is stopped to complete the molten metal injection/filling cycle.

If the volume of molten metal injected into the injection sleeve 3 exceeds a reference volume, the time Ta when the forward drive pressure P gets to the predetermined value Pset comes earlier by $\alpha$. Then, the injection speed control program starts at time Ta-$\alpha$, using the same speed profile, so that the speed profile is forwardly shifted by $\alpha$ as indicated by a broken line In FIG. 3.

If, to the contrary, the volume of molten metal injected into the injection sleeve 3 is short of the reference volume, the time Ta when the forward drive pressure gets to the predetermined value Pset is delayed later by $\beta$. Then, the injection speed control program starts at time Ta+$\beta$, using the same speed profile, so that the speed profile is rearwardly shifted by $\beta$ as indicated by another broken line in FIG. 3.

Thus, any variance in the volume of molten metal injected into the injection sleeve 3 is absorbed by a corresponding variance in the wall thickness of the biscuit section formed of molten metal remaining in the front end of the injection sleeve 3 so that the volume injected into the metal mold 7 from the injection sleeve 3 is always held constant. Differently stated, even if the volume of molten metal injected into the injection sleeve 3 is differentiated from the reference volume, the forced deceleration phase always starts at a right time point so that no pressure rise time lag due to an interrupted flow of molten metal nor appearance of flashes or fins due to an excessive supply of molten metal would take place to ensure the production of high precision and high quality die cast products.

Additionally, even if the maximum rate plateau phase cannot be controlled by feed-back because of a very high maximum rate V2, the injection speed control program can always be started when the forward drive pressure P gets to a predetermined value Pset, using the preselected speed profile. In addition, the speed profile can be modified by the achievement in the past to establish a stabilized speed pattern for the subsequent injection cycles.

Still additionally, a sufficient time can be allowed to the molten metal injected into the metal mold for raising its pressure by detecting the time point when the advance drive pressure P gets to a predetermined value Pset and controlling the rate of deceleration of the deceleration phases of the speed profile to ensure the production of high quality die cast products.

Figure 4:
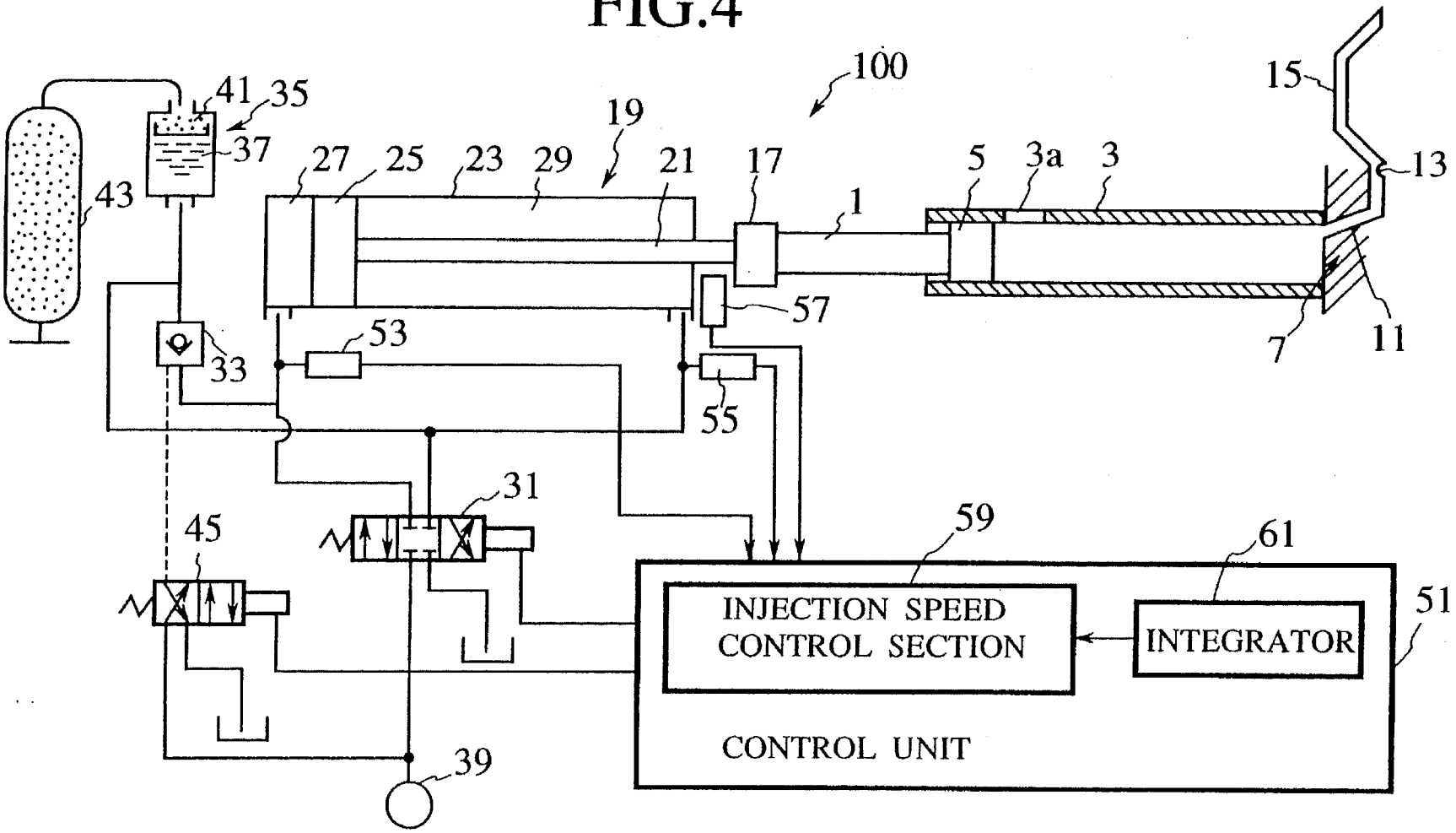

FIG. 4 is a schematic block diagram of another embodiment of injection control apparatus of a die casting machine according to the invention. The components of this embodiment that are similar to those of FIG. 1 are denoted by the same reference symbols and will not be described any further.

In this embodiment, the control unit 51 comprises an integrator 61 for calculating the integral of the continuously rising forward drive pressure P and the injection speed control section 59 receives a signal representing the integral value with time obtained by the integrator 61 and the injection speed control section 59 maintains the rate of advancement V of the plunger rod 1 to a low injection rate (initial rate) V1 until the integral value gets to a predetermined value, calculates the rate of advancement V of the plunger rod 1 from change with time of the displacement of the plunger rod 1 detected by the displacement sensor 57 and controls by feed-back the rate of advancement V of the plunger rod 1 so as to make it get to a target value. Once the integral value gets to a predetermined value, it switches the rate of advancement V of the plunger rod 1 from the low injection rate to a high injection rate.

Therefore, this embodiment differs from the above embodiment only in that the injection speed control program starts when the integral value with time of the continuous rise of the forward drive pressure P gets to a predetermined value in this embodiment, whereas it starts when the forward drive pressure P itself gets to a predetermined value in the above embodiment. Thus, the both embodiments can provide similar functions and effects.

Furthermore, this embodiment provides an additional advantage of avoiding a situation where the injection speed control program starts by error when the forward drive pressure P is temporarily raised by external turbulence and/or mechanical resistance of the plunger before the charge of molten metal gets to the gate section 13 because the injection speed control program is designed to start only when the integral value with time of the rise of the forward drive pressure P gets to a predetermined value.

While this embodiment is designed to start the operation of the injection speed control program for high rate injection, using a speed profile, when the charge of molten metal gets to the gate section, the technique that can be used for controlling the injection of a die casting machine is not limited thereto and a multi-stage control technique or any other appropriate technique may alternatively be used so far as the condition is satisfied that when the charge of molten metal gets to the gate section, the operation of high rate injection are started.

It will also be understood by those skilled in the art that the present invention is not limited to the above embodiments, which may be subject to various modifications without departing the scope of the invention.

As described above, according to the first and third aspects of the invention, there are provided a method and an apparatus of controlling the injection of a die casting machine characterized in that the pressure of the plunger rod charging the metal mold with molten metal is detected and the operation of controlling the injection speed is started when the detected pressure gets to a predetermined value, determining that the charge of metal mold has arrived the gate section of the metal mold, so that no pressure rise time lag due to an interrupted flow of molten metal nor appearance of flashes or fins due to an excessive supply of molten metal would take place to ensure the production of high precision and high quality die cast products on a stable basis.

According to the second and fourth aspects of the invention, there are provided a method and an apparatus of controlling the injection of a die casting machine characterized in that the continuous rise of the pressure of the plunger rod charging the metal mold with molten metal is integrated with time and the operation of controlling the injection speed is started when the integral value gets to a predetermined value, determining that the charge of metal mold has arrived the gate section of the metal mold so that no pressure rise time lag due to an interrupted flow of molten metal nor appearance of flashes or fins due to an excessive supply of molten metal would take place to further ensure the production of high precision and high quality die cast products on a stable basis.

Furthermore, there is provided an additional advantage of avoiding a situation where the injection speed control program starts by error when the forward drive pressure is temporarily raised by external turbulence and/or mechanical resistance of the plunger before the charge of molten metal gets to the gate section because the injection speed control program is designed to start only when the integral with time of the rise of the forward drive pressure gets to a predetermined value.

With each of the above described methods may be so arranged that a low injection speed phase of an injection stroke continues until the pressure of the plunger rod gets to a predetermined value or the integral value of the continuous rise of pressure with time gets to a predetermined value and the rate of advancement of the plunger rod is controlled by feed-back so as to gets to a target value in this phase or in the initial phase of the injection/charging stroke. With such an arrangement, when the pressure of the plunger rod gets to the predetermined value or the integral value of the continuous rise of pressure with time gets to the predetermined value, the initial phase of the injection/charging stroke is terminated and the plunger rod is made to follow a predetermined speed profile as a function of the displacement of the plunger rod. Therefore, even if amount of the molten metal is various, control of injection speed by program is properly executed without requiring a metal charge front sensor or without modifying the metal mold, thereby always acquiring high precision and high quality die cast products. Furthermore, the setting of decelerating part of the speed profile enables the plunger rod to be properly decelerated and stopped. For this reason, even if the top speed of the plunger under program control becomes ultra high speed, high precision and high quality die cast products can be acquired.

What is claimed is:

1. A method of controlling the injection of a die casting machine for injecting molten metal fed to an injection sleeve into a metal mold by means of an injection plunger to charge the metal mold with molten metal, comprising the steps of:

detecting the pressure of a plunger rod charging the metal mold with molten metal;

determining that the molten metal has arrived the gate section, or injection port, of the metal mold at a time when the detected pressure gets to a predetermined value; and controlling the injection speed on the basis of the time.

2. A method of controlling the injection of a die casting machine for injecting molten metal fed to an injection sleeve into a metal mold by means of an injection plunger to charge the metal mold with molten metal, comprising the steps of:

detecting pressure of a plunger rod charging the metal mold with molten metal;

integrating continuous rise of the pressure with time;

determining that the molten metal has arrived the gate section, or injection port, of the metal mold at a time when the integral value gets to a predetermined value; and controlling the injection speed on the basis of the time.

3. A method of controlling the injection of a die casting machine according to claim 1 or 2, wherein:

the operation of controlling the injection speed is executed in such that, before the time, the rate of advancement of the plunger rod is controlled by feed-back so as to make it a target value, and after the time, the rate of advancement of the plunger rod is controlled according to a predetermined profile which is defined as a function of a position of the plunger rod and which includes a forced speed reduction part before the completion of injection.

4. An apparatus of controlling the injection of a die casting machine for injecting molten metal fed to an injection sleeve into a metal mold by means of an injection plunger to charge the metal mold with molten metal, comprising:

a detection means for detecting pressure of a plunger rod charging the metal mold with molten metal; and an injection speed control means for receiving a detection signal from said detection means, operating a low injection speed phase for the advancement of the plunger rod until the detected pressure gets to a predetermined value, and switching the operation from the low injection speed phase to a high injection speed phase when the detected pressure gets to the predetermined value.

5. An apparatus of controlling the injection of a die casting machine for injecting molten metal fed to an injection sleeve into a metal mold by means of an injection plunger to charge the metal mold with molten metal, comprising:

a detection means for detecting pressure of a plunger rod charging the metal mold with molten metal;

an integrator for integrating with time the continuous rise of the pressure detected by the detection means; and an injection speed control means for receiving an integral value from said integrator and switching an operation of the plunger rod from a low injection speed phase to a high injection speed phase when the integral value gets to a predetermined value.

* * * * *